US005860379A

United States Patent [19]

Moody

[11] Patent Number: 5,860,379

[45] Date of Patent: Jan. 19, 1999

[54] INFLATABLE FLOATING BOAT LIFT

[76] Inventor: Kenneth D. Moody, 5023 N. Pennsylvania St., Indianapolis, Ind. 46205

[21] Appl. No.: 916,653

[22] Filed: Aug. 22, 1997

[51] Int. Cl.[6] ..... B63C 7/00

[52] U.S. Cl. ..... 114/54; 114/45; 114/263

[58] Field of Search ..... 114/44, 45, 48–50, 114/52–54, 263; 405/3, 11–14

[56] References Cited

U.S. PATENT DOCUMENTS

| | | | |
|---|---|---|---|
| 26,856 | 1/1860 | McKeen . | |
| Re. 34,793 | 11/1994 | Peck | 114/45 |
| 515,878 | 3/1894 | Hadley et al. . | |
| 3,570,256 | 3/1971 | Thompson | 61/48 |
| 4,072,119 | 2/1978 | Williams et al. | 114/45 |
| 4,075,965 | 2/1978 | Lasch | 114/49 |
| 5,078,071 | 1/1992 | Miura | 114/45 |
| 5,094,181 | 3/1992 | Fuerst | 114/54 |
| 5,140,922 | 8/1992 | Bowman | 114/45 |
| 5,341,756 | 8/1994 | Hinze | 114/54 |

FOREIGN PATENT DOCUMENTS

| | | | |
|---|---|---|---|
| 125691 | 5/1991 | Japan | 114/45 |

*Primary Examiner*—Jesus D. Sotelo

[57] ABSTRACT

An inflatable floating boat lift device constructed of a flexible impermeable fabric comprising main air chambers and a network of hoses and valves connected to a blower controlling the inflation and deflation of each main chamber independently. This device provides vertical lifting and stability of the boat while floating at the surface of the water. There are smaller adjustable buoyancy devices inside the main air chambers that provide floatation of the device when the main chambers are deflated. These buoyancy devices also guide the boat onto the lifting device. On some embodiments, a level sensing device activates blowout plugs that rapidly return the boat to it's original floating position.

25 Claims, 8 Drawing Sheets

INFLATABLE FLOATING BOAT LIFT

BACKGROUND-FIELD OF INVENTION

This invention, which relates to boats of any types, will raise and lower a boat out of the water for mooring thereby protecting the hull from the harmful effects of the water.

1. Background

Owning a boat can require a high level of maintenance. To reduce the amount of time spent storing, transporting, and launching their boat, many owners choose to moor their boat. However, leaving a boat in the water will cause a build-up of growth and residue on the hull. This growth can cause permanent staining of the hull and even blistering of a fiberglass hull. At the very least, this growth and residue will require a significant amount of cleaning.

There are currently several devices on the market that address this problem by lifting the boat above the water level. Although there are many designs, they are basically large mechanical structures with several inherent drawbacks. Besides being quite expensive, these structures are usually too bulky and difficult for the user to transport and install himself. In many cases, the mooring slips provided by marinas are not wide enough to accommodate these devices. Also, some of these structures are supported by feet that rest on the bottom of the lake or river. These feet require a firm bottom with minimum and maximum depth limitations. The feet usually support a rack device that in turn supports a movable platform that supports the boat hull. The rack device is usually raised by a winch system either manually or by an electric motor. Once installed, these systems often need adjustment for changing water levels. It is not uncommon for a boat to become stuck on the lift because the water has dropped to a level lower than the lowest point of travel of the platform. It is also not uncommon for the feet of these devices to sink too far into the bottom and cause tilting of the device.

There is also a system on the market that uses large pontoons to support a platform. These pontoons sink as water fills them and raise again as the water is forced out and replaced with air. This system has no maximum water depth limitation and adjusts automatically for changing water levels. However, it does have a minimum water depth limitation and is much more expensive than previously mentioned systems. This type of lift also requires significant structural support from and mechanical connections to the dock itself. Many marinas do not allow these connections. This type also requires 110 volt AC electrical power which is often not available at the dock.

Another drawback of these mechanical systems is that they can cause significant damage to the hull or propeller if the boat is misguided onto the lifting device. And, they do not allow the boat to be lifted at an angle to facilitate draining of the hull through the transom drain. Also, because of their size, they are often stored near the water in a very unsightly manner in a users' yard. There are other types of boat lifting systems that are basically overhead hoists. These systems do not have water depth limitations but are also quite expensive and also require a significant overhead structure and dock structure and are very difficult to install or relocate.

2. Prior Art

Devices for lifting boats are among some of the oldest found in the patent art. U.S. Pat. No. 515,878 to Haley and Foster, March 1894 teaches a multiplicity of inflatable bags covered with a heavy netting of cord or rope, joined together by chains. U.S. Pat. No. 4,075,965, to Lasch, February 1978 teaches inflatable cylindrical bodies positioned beneath a boat and secured in place with straps. These are for the purpose of lifting the boat high enough to drain water from the boat through the transom drain opening. U.S. Pat. No. 5,341,756 to Hinze, August 1994 teaches an apparatus with flexible, inflatable toroidal shaped floatation devices with bands for securing them relative to the watercraft. U.S. Pat. No. 3,570,256, to Thompson, March 1971 teaches an inflatable birth for covering the water-submerged portion of a boat to entrain water against the hull for stagnation of the entrained water.

The above mentioned inventions teach some of the elements of this invention but they do not teach all of the elements nor the combinations. Specifically, none of these teach a device that will keep itself floating in position ready to accept the boat. Nor do any of these teach a device that guides the boat into the proper position on the device; nor do they teach a device that does not require strapping or mechanically fastening the lifting device to the boat. Thompson teaches a device suspended vertically by securing it to a boat slip but does not teach a lifting device.

OBJECTS AND ADVANTAGES

Accordingly, several objects and advantages of this invention are:

1. to provide a more affordable boat lifting device
2. to provide a boat lifting device that works in any water depth adequate to float the boat
3. to provide a boat lifting device that will accommodate changing water levels
4. to provide a boat lifting device that is easier to transport
5. to provide a boat lifting device that is easier to install and remove
6. to provide a boat lifting device that is easier to store out of sight
7. to provide a boat lifting device that cannot damage the boat hull or propeller
8. to provide a boat lifting device that will facilitate draining of the boat hull
9. to provide a boat lifting device that does not require 110 volt electrical current or manual labor for operation.

Still further objects and objectives will become apparent from a consideration of the ensuing description and drawings.

DESCRIPTION OF DRAWINGS

In the drawings, closely related figures have the same number but different alphabetic suffixes. Some figures show components that are not part of the invention but are necessary to show for clarity of a particular embodiment of the invention. These components are identified in the following list of Reference Numerals with an asterisk. The word boat is used to describe a variety of watercraft including but not limited to; pleasure boats, larger boats or ships, personal watercraft, or sailboats.

Figure 1A:
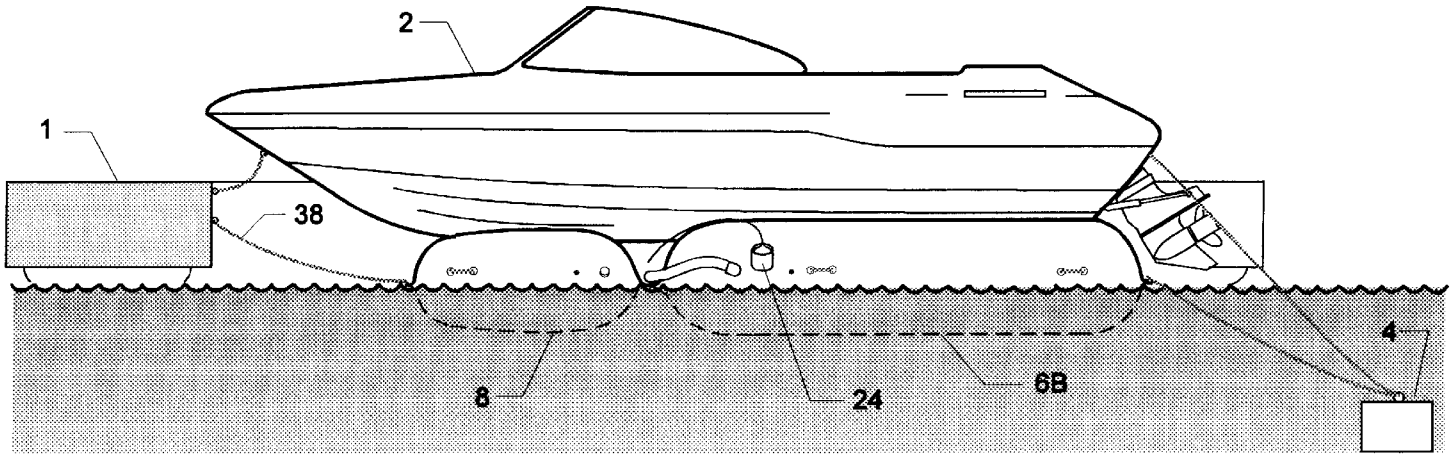
FIG. 1A—is an elevation from the side showing a boat supported by the inflatable floating boat lift.

| List of Reference Numerals | |
|---|---|
| 1. | boat dock* |
| 2. | boat* |
| 3. | 12 volt battery* |
| 4. | anchor* |
| 5. | airbag assembly |
| 6A. | main right air chamber |
| 6B. | main left air chamber |
| 8. | front air chamber |
| 10A. | inside main right air chamber |
| 10B. | inside main left air chamber |
| 12A. | inside front right air chamber |
| 12B. | inside front left air chamber |
| 14. | fill tube |
| 16. | fill valve with cap |
| 18. | right chamber air hose |
| 20. | left chamber air hose |
| 22. | front chamber air hose |
| 24. | rigid cylinder |
| 26. | inflatable pipe plug |
| 28. | fill valve |
| 30. | handle |
| 32. | grommet |
| 34. | boat position marker |
| 36. | rope |
| 38. | stabilizing ropes |
| 40. | level sensing assembly |
| 42. | electrical wires |
| 44. | mercury switch |
| 45. | mounting bracket |
| 46. | electrical plug |
| 47. | electrical receiver |
| 48. | rapid deflation control assembly |
| 50. | air pump* |
| 52. | air fill checkvalve |
| 54. | pressure gauge |
| 56. | popoff valve |
| 58. | solenoid valve, toggle type |
| 60. | quick-disconnect-plug |
| 62. | quick-disconnect-receiver |
| 64. | air hose |
| 66. | air manifold |
| 68. | air valves |
| 70. | electric blower |
| 72. | trough |
| 80. | airbag assembly for boat with fin |
| 82. | airbag assembly for small boat or personal watercraft |
| 84. | two valve manifold |
| 86. | right air chamber |
| 88. | left air chamber |
| 90. | airbag assembly for large boat |
| 92. | four valve manifold |
| 93. | front right air chamber |
| 94. | front left air chamber |
| 95. | front right chamber air hose |
| 96. | front left chamber air hose |
| 100. | airbag assembly for sailboat |
| 106. | rigid frame |
| 107. | rope guides |
| 108. | pull ropes |

-continued

| List of Reference Numerals | |
|---|---|
| 109. | pegs |
| 110. | loop for pull rope |
| 112. | pull handle |
| 114. | cylinder |
| 116. | bar |
| 118. | loop |
| 120. | sailboat* |
| 122. | sliding support assembly |

*shown for clarity but not part of this invention

DESCRIPTION OF INVENTION FIGS. 1A, 1B, 1C, 2, 3

Figure 1B:
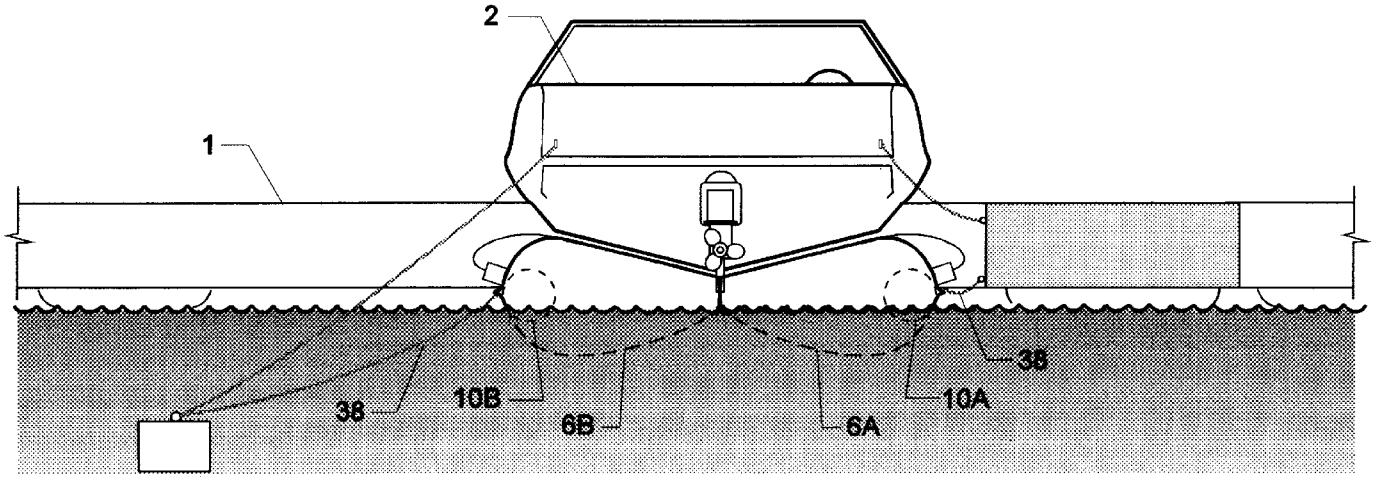
FIG. 1B—is an elevation from the back showing a boat supported by the inflatable floating boat lift.

FIG. 1A (elevation) and FIG. 1B (elevation) show a typical embodiment of the invention.

A boat 2 is supported vertically above water by an airbag assembly 5 that floats on the water. Boat 2 is supported against horizontal movement by connecting boat 2 itself to a nearby dock 1 in at least three directions with a plurality of ropes 38. If a portion of dock 1 is not present in one or more directions, then boat 2 would be connected by ropes 38 to at least one anchor 4 placed in the direction of needed support. By connecting to boat 2, rather than to airbag assembly 5, point loads on airbag assembly 5 are eliminated.

Figure 1C:
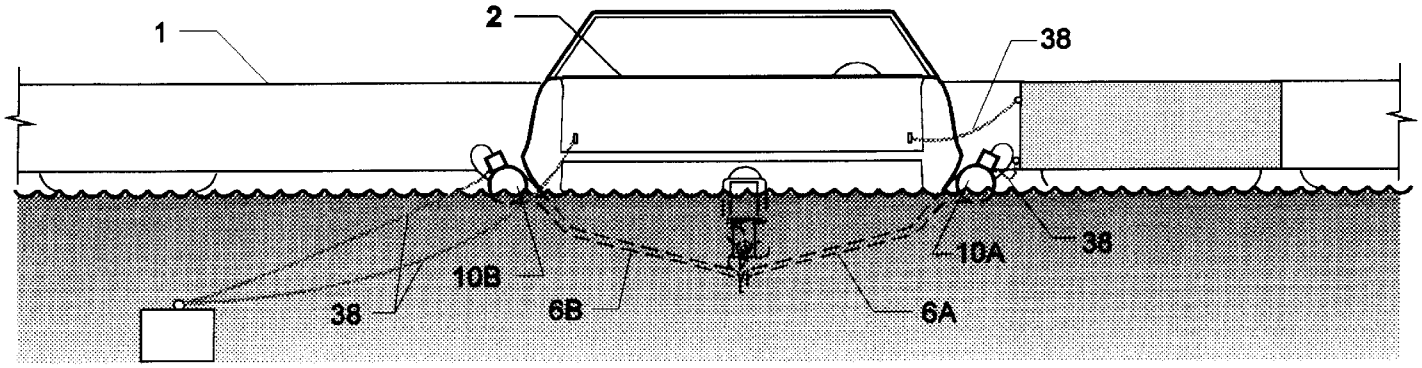
FIG. 1C—is an elevation from the back showing a boat driven onto the inflatable floating boat lift.

FIG. 1C (elevation) shows a typical embodiment of the invention in the deflated position.

Boat 2 has been driven onto airbag assembly 5 which is held floating in the water by auxiliary air chambers 10A, 10B, 12A, and 12B.

Figure 2:
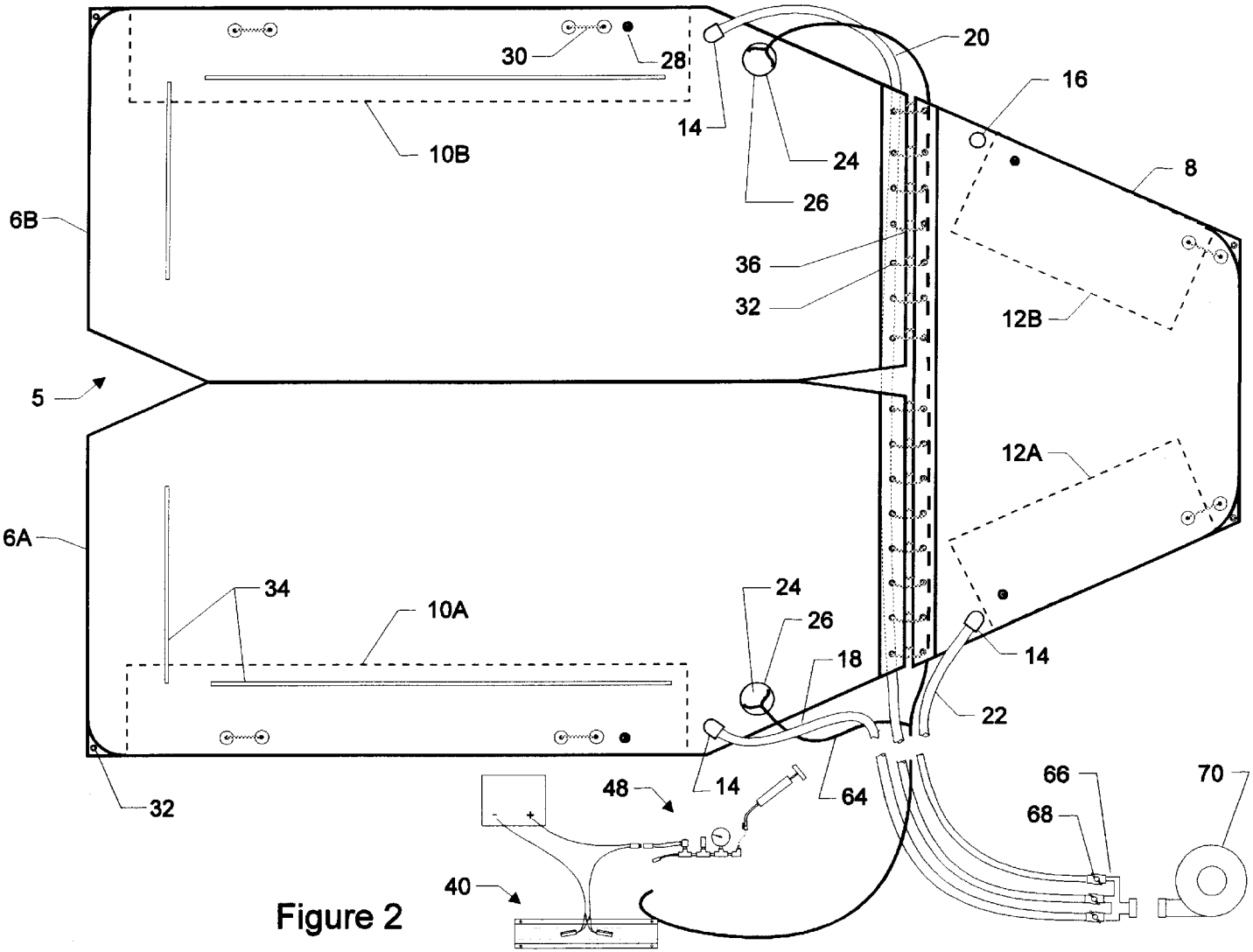
FIG. 2—is a plan view of the inflatable floating boat lift laying flat and deflated.

FIG. 2 (plan) shows airbag assembly 5 laying flat and deflated.

Airbag assembly 5 comprises two major air chambers 6A and 6B and a front air chamber 8. Main air chambers 6A and 6B are connected to each other. Front air chamber 8 is connected to air chambers 6A and 6B with a rope 36 threaded through a plurality of grommets 32. Therefore, front air chamber 8 can be removed for easier shipping, handling, and storage. Air hoses 18,20 and 22 are connectable to air chambers 6A, 6B, and 8 respectively provide air to them, therefore enlarging them. Air chambers 6A, 6B, and 8 are constructed of a flexible impermeable fabric. Each main air chamber 6A and 6B is controlled separately by a valve 68. Valves 68 are connected to a manifold 66 which can be connected to a blower 70. Blower 70 may be powered by a 110 volt AC circuit if available at dock 1. Blower 70 may also be powered by a 12 or 24 volt DC circuit from boat 2 itself.

Main auxiliary air chambers 10A and 10B are constructed of a flexible impermeable fabric and connected to an inside wall of main air chambers 6A and 6B. Front auxiliary air chambers 12A and 12B are also constructed of a flexible impermeable fabric and connected to an inside wall of front air chamber 8. All auxiliary air chambers 10A, 10B, 12A, and 12B are connected to and inflated through valves 28, therefore enlarging them.

Of course it will be realized that main auxiliary air chambers 10A and 10B and front auxiliary air chambers 12A and 12B could be attached externally to main chambers 6A and 6B, or front chamber 8 respectively.

In another embodiment of the invention, main auxiliary air chambers 10A and 10B and front auxiliary air chambers 12A and 12B may be replaced with non-inflatable devices such as foam, hollow structures, or any structures or materials with density less than that of water.

A plurality of grommets 32 are attached to airbag 5 and provide connecting points to secure airbag 5 to dock 1 or anchor 4 or anchors 4 with a plurality of ropes 38. A plurality of handles 30 are attached to air chambers 6A, 6B and 8. Also, a plurality of position markers 34 are attached to air chambers 6A and 6B.

A plurality of inflatable pipe plugs 26 are inserted into a plurality of rigid cylinders 24 which are attached to main air chambers 6A and 6B. Pipe plugs 26 are inflated and deflated through an air hose 64. Pipe plugs 26 are actuated by a rapid deflation control assembly 48 which is actuated by a level sensing assembly 40.

Figure 3:
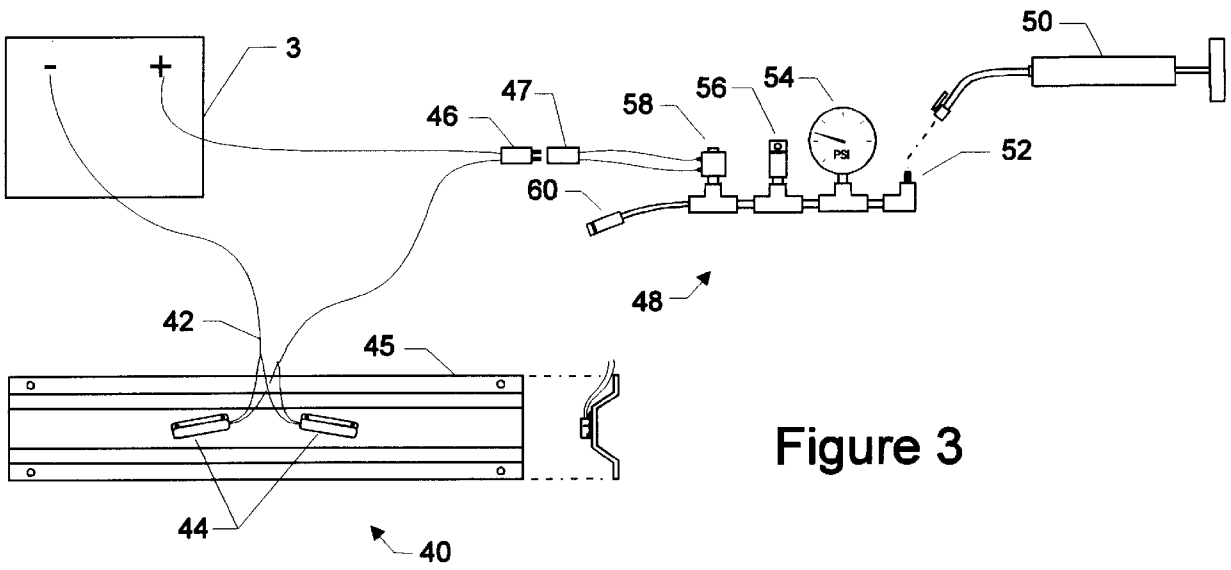
FIG. 3—is an elevation of a level sensing assembly and a rapid deflation control assembly.

FIG. 3 (elevation) shows a level sensing assembly 40 and a rapid deflation control assembly 48.

A level sensor assembly 40 is mountable on a vertical cross component, such as a transom, inside of boat 2. A pair of mercury switches 44 is mounted on a mounting bracket 45 at specific opposite angles. A plurality of wires 42 connect mercury switches 44 to a battery 3 of boat 2 and to an electrical plug 46 and a receiver 47 which connects to a rapid deflation control assembly 48. A solenoid valve 58 is connected by fittings to a pressure popoff valve 56 and to a pressure gauge 54 and to an air fill checkvalve 52 and to a quick-disconnect plug 60. An air pump 50 can be attached to air fill checkvalve 52.

In another embodiment of the invention, although not shown in the drawings, level sensor assembly 40 could replaced by a gyroscope, such as those used in airplanes, or a hanging pendulum device, such as those used in pinball machines, which makes contact with an electrode if the device is tilted beyond a preset angle. Or, level sensor assembly 40 could be replaced with a mechanical device that activates upon tilting therefore releasing air from pipe plugs 26. This device could be a steel ball held by gravity in a bracket where the weight of the steel ball holds a spring loaded valve shut, and when tilted causes the ball to roll off of the bracket thereby releasing the valve.

OPERATION FIGS. 1A, 1B, 1C, 2, 3

Before placing airbag 5 in the water front air chamber 8 is connected to air chambers 6A and 6B. Also auxiliary chambers 10A, 10B, 12A, and 12B should be at least partially inflated through fill valves 28. Auxiliary air chambers 10A, 10B, 12A, and 12B provide buoyancy to hold airbag 5 in a floating position on top of the water until boat 2 is driven onto it. Then, pipe plugs 26 are inserted into rigid tubes 24 and inflated through control assembly 48. Air pump 50 is connected to check valve 52 and pumped until popoff 56 is actuated to inflate pipe plugs 26. The pressure can then be monitored by pressure gauge 54. Then airbag 5 is placed in the water and secured in place with ropes 36. Ropes 36 are connected to grommets 32 at corners of airbag 5 and to boat dock 1 and to anchor 4 or anchors 4 if necessary.

Boat 2 is driven onto airbag 5. Air chambers 10A and 10B guide boat 2 onto a top surface of airbag 5 for receiving the hull. Air chambers 12A and 12B stop boat 2 at the proper forward position. At this point, boat 2 is secured in place with mooring ropes 38. Then, main auxiliary air chambers 10A and 10B are adjusted in size by adding or deleting air. This causes the remaining space of airbag 5 that receives the hull of boat 5 to change in size to fit tightly to the hull of the boat. And, because of their wedge orientation, front auxiliary air chambers 12A and 12B can also be adjusted in size, by adding or removing air, to provide a stopping point for boat 2. These adjustments are only necessary the first time the airbag 5 is placed in the water. Position markers 34 provide a reference mark to gage the alignment of boat 2 after it has been driven onto airbag 5. In case boat 2 is still not fairly well aligned with airbag 5, handles 30 provide a gripping point for moving the airbag 5 manually into a better position under boat 2. Handles 30 can also be used for transporting and folding airbag 5. Next, main air chambers 6A and 6B and front chamber 8 are inflated with blower 70, therefore enlarging them until the bottom and a propeller of boat 2 are lifted out of the water. As boat 2 is raised, the amount of air supplied to chambers 6A and 6B can be controlled individually from valves 68 therefore controlling the side to side list of the boat. Also, as boat 2 is raised, the amount of air supplied to chamber 8 can be controlled from valve 68 therefore controlling the front to back list of the boat. Air chambers 6A and 6B provide a primary lifting surface, side to side stability against wave action, and list adjustment. Front air chamber 8 provides a secondary lifting surface, front to back stability from wave action, and attitudinal adjustment.

After boat 2 has been raised, plug 46 is connected to receiver 47 to enable level sensing assembly 40. Level sensing assembly 40 is mounted in boat 2 in a position that will detect side to side list. Undesirable list could occur from wind or wave motion or from a leak in one of the air chambers 6A or 6B. Mercury switches 44 of sensor 40 are mounted at opposite angles to each other. Because of this, one of them will close if they are tilted greater than the angle at which they are mounted. This will cause solenoid 58 to open and release air pressure from pipe plugs 26 allowing them to constrict in size. Then air pressure from chambers 6A and 6B will push plugs 26 out of cylinders 24. This will allow air to rush out of air chambers 6A and 6B and allow boat 2 to lower itself very rapidly into the water where it is safe against tipping.

To lower boat 2 into the water for daily use, simply open valves 68 letting air out of air chambers 6A , 6B and 8. Disconnect plug 47 from receiver 48 disabling level sensing assembly 40. Then disconnect mooring ropes 38 from boat 2. Level sensing assembly 40 stays in boat 2.

Occasionally, it may be necessary to drain rain water from a transom drain of boat 2. To do this, chambers 6A and 6B can be under-inflated and front chamber 8 can be over-inflated thus changing the attitude of boat 2 to allow drainage.

At the end of the boating season, airbag 5 is easily removed, cleaned, rolled or folded up, and stored out of sight for the winter.

DESCRIPTION OF INVENTION FIG. 4

Figures 4, 4A:
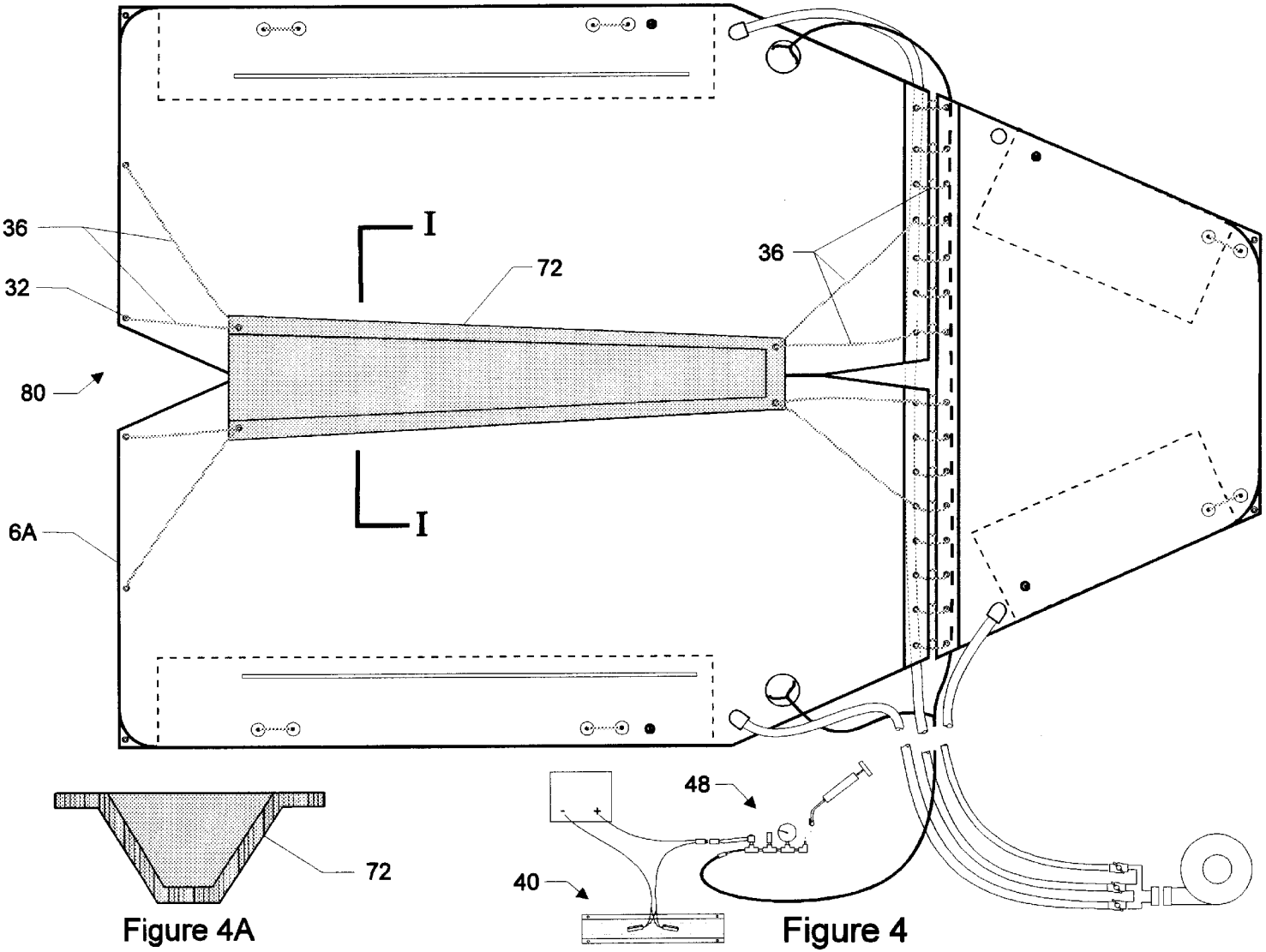
FIG. 4—is a plan view of the inflatable floating boat lift laying flat and deflated for a boat with a fin.

FIG. 4 (plan) shows another embodiment of the invention for use with a boat having at least one fin on the bottom of its hull.

This embodiment is very similar to the primary embodiment except that it contains a rigid trough 72 held in place by ropes 36 that connect to grommets 32 mounted to main air chambers 6A and 6B.

Section A—A shows a cross section of plastic trough 72.

OPERATION FIG. 4

The operation is the same as described in operation of FIG. 1A, 1B, 1C, 2, 3 above except that rigid trough 72 protects airbag 5 from a sharp fin or fins normally located on the bottom of some boats.

DESCRIPTION OF INVENTION FIG. 5

Figure 5:
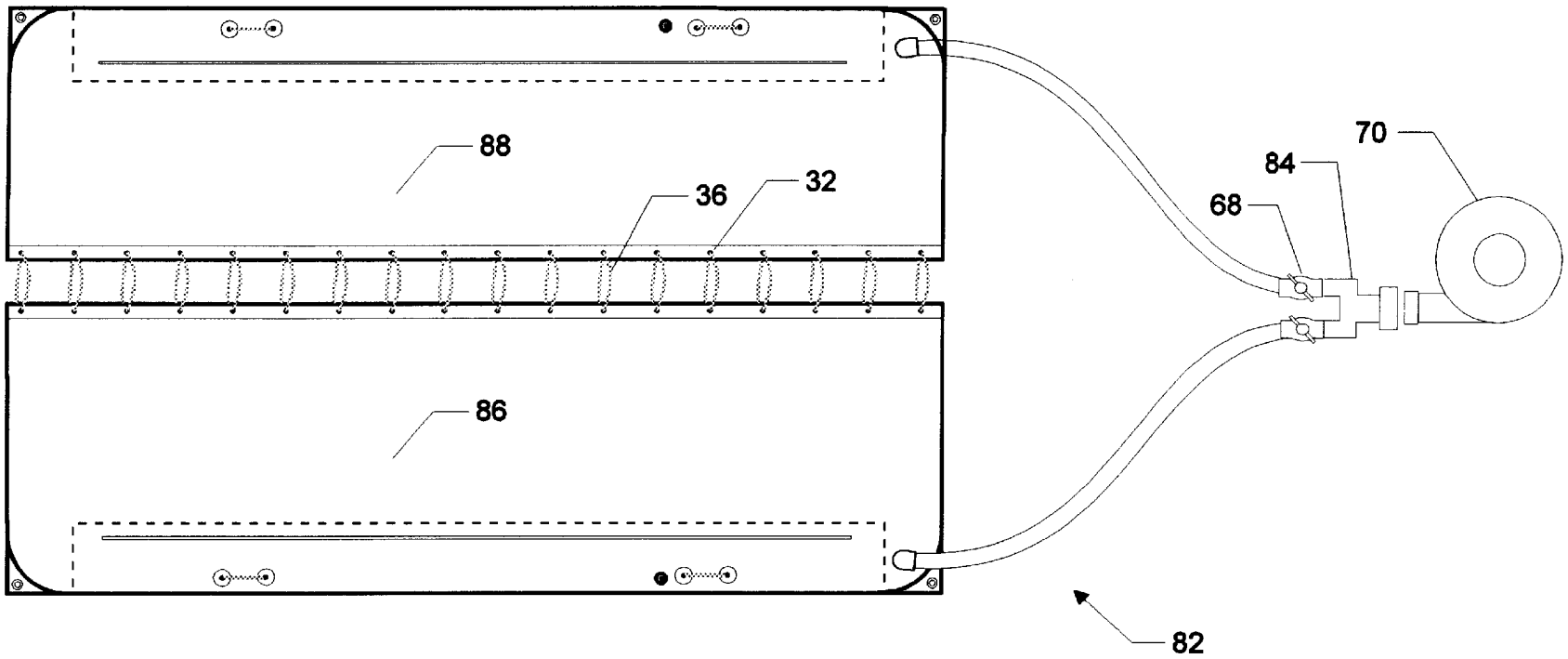
FIG. 5—is a plan view of the inflatable floating boat lift laying flat and deflated for a small boat or personal watercraft.

FIG. 5 (plan) shows another embodiment of the invention for use with a small boat or personal watercraft.

This embodiment is similar to the primary embodiment except that front chamber 8 is eliminated. Main air chambers 6A and 6B are arranged side by side in a pair and do not contain rigid cylinders 24 nor pipe plugs 26. Also, main air chambers 6A and 6B are separated but connected with ropes 36 through grommets 32. A two valve manifold 84 connects valves 68 to blower 70. Assembly 40 and assembly 48 are also eliminated.

OPERATION FIG. 5

The operation is the same as described in operation of FIG. 1A, 1B, 1C, 2, 3 above except for the portion relating to front chamber 8, front auxiliary air chambers 12A and 12B, rapid deflation control assembly 48, and level sensing assembly 40.

DESCRIPTION OF INVENTION FIG. 6

Figure 6:
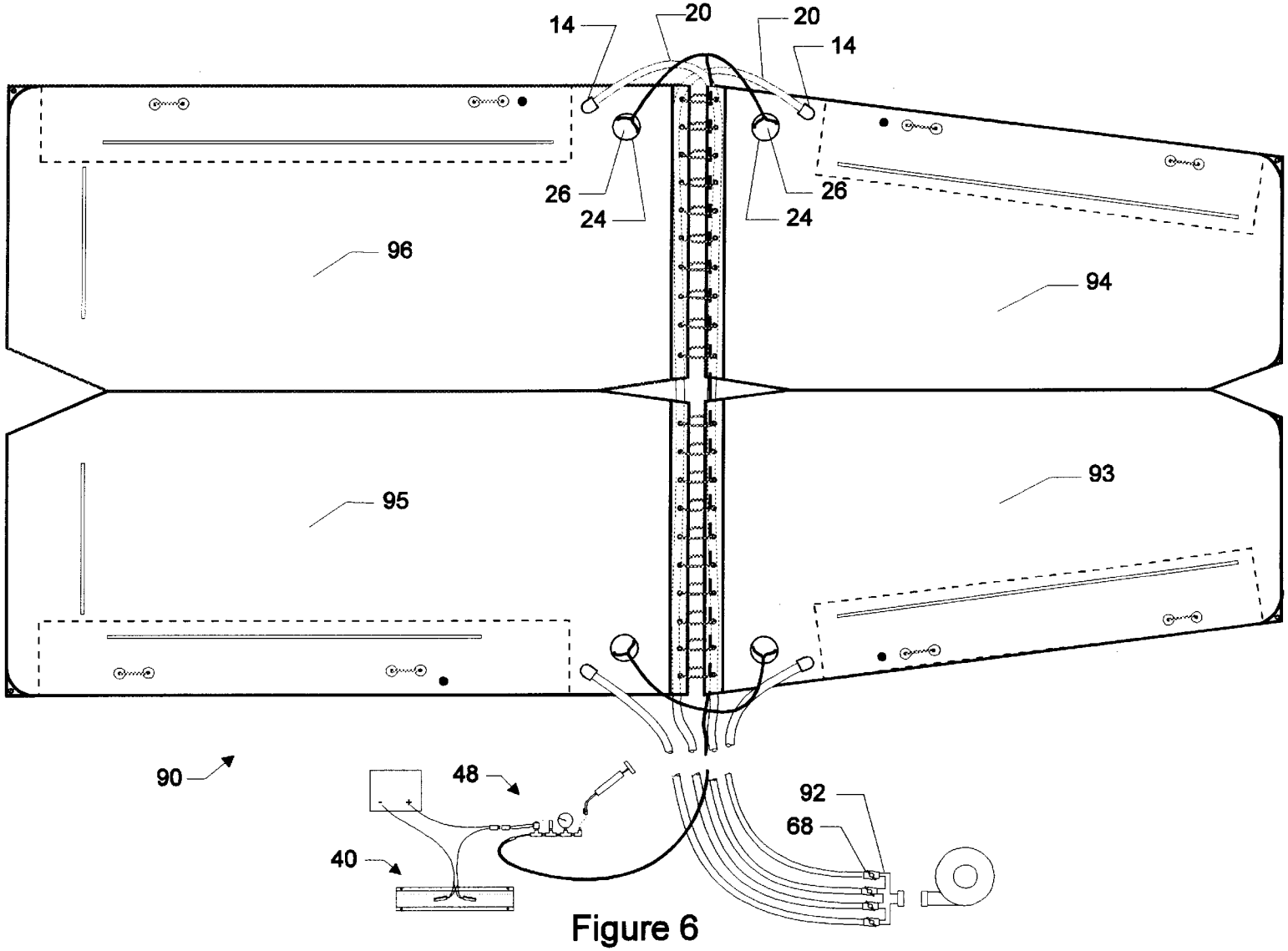
FIG. 6—is a plan view of the inflatable floating boat lift laying flat and deflated for a large boat or ship.

FIG. 6 (plan) shows another embodiment of the invention for use with a large boat or ship.

This embodiment is similar to the primary embodiment except that front chamber 8 is replaced by front right air chamber 93 and front left air chamber 94. Air chambers 93 and 94 also have rigid cylinders 24 mounted to them with pipe plugs 26 inserted into cylinders 24. Pipe plugs 26 are also connected to air hose 64 and actuated by assembly 48. Air chambers 93 and 94 are connectable to and inflated and deflated through air hoses 95 and 96 respectively. They are also controlled with valves 68 which are connected to a four valve manifold 92. Auxiliary air chamber 12A is attached to the inside wall of front right air chamber 93 and auxiliary air chamber 12B is attached to the inside wall of front left air chamber 94.

Whereas main air chambers 6A and 6B and front air chambers 93 and 94 may be arranged in multiples or combinations other than those shown. Such as three or four pairs in a linear array, or a combination of pairs of air chambers and single air chambers so far described as front chamber 8. Further, even one single air chamber by itself, or more than one single air chamber can be utilized by adjoining them together in a linear array.

OPERATION FIG. 6

The operation is the same as described in operation of FIG. 1A, 1B, 1C, 2, 3 except that front air chambers 93 and 94 are inflated through air hoses 95 and 96 and through valves 68 connected to four valve manifold 92. The other difference is that the list is controlled by adding air to air chambers 6A and 93 together or to air chambers 6B and 94 together and the attitude is controlled by adding air to air chambers 6A and 6B together or to air chambers 93 and 94 together.

DESCRIPTION OF INVENTION FIGS. 7, 8

Figure 7:
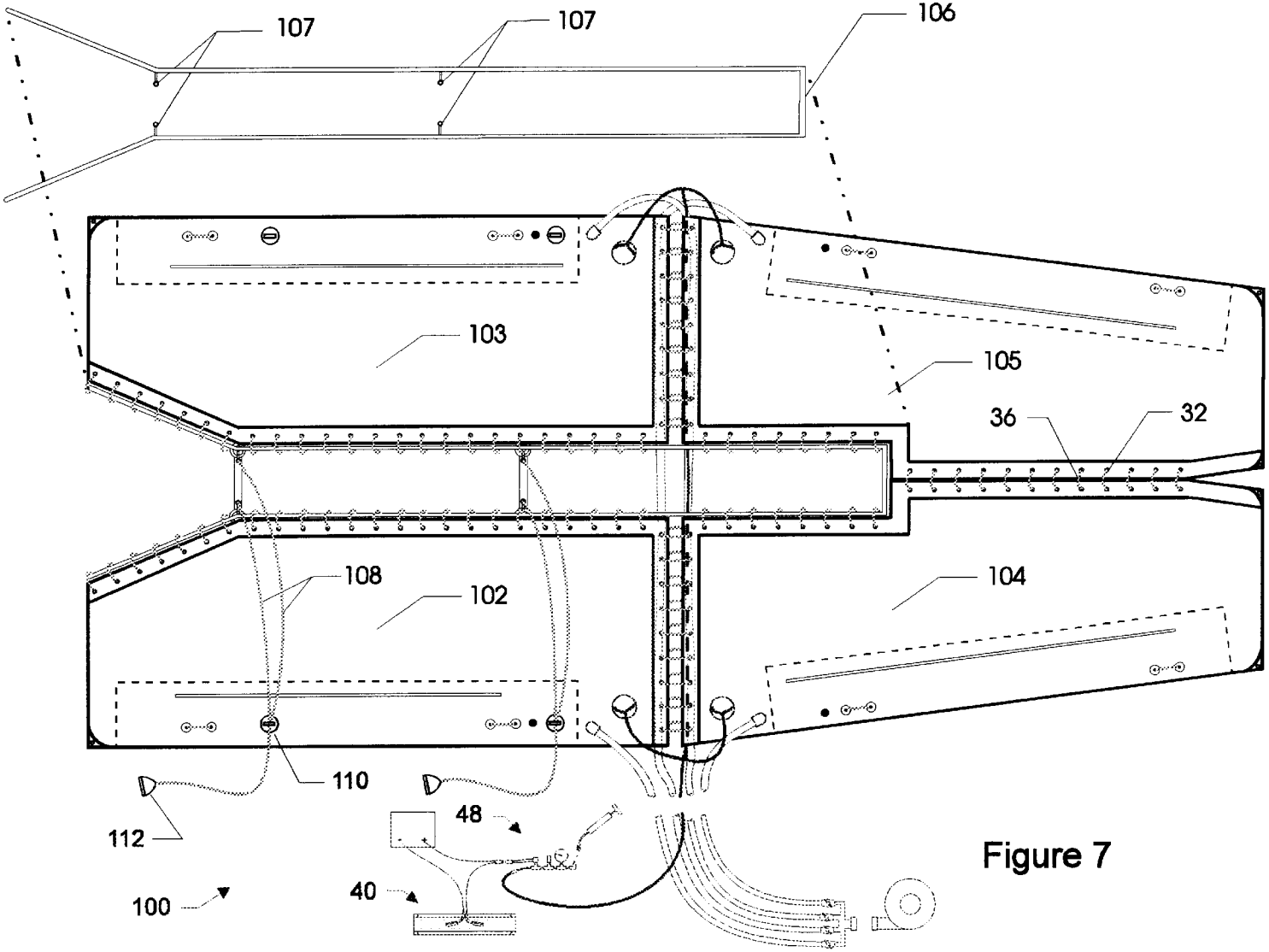
FIG. 7—is a plan view of the inflatable floating boat lift laying flat and deflated for a sailboat with an exploded isometric view of a rigid frame.

FIG. 7 (plan) shows another embodiment of the invention for use with a sail boat with a separate (isometric) view of a rigid frame device.

Figure 8:
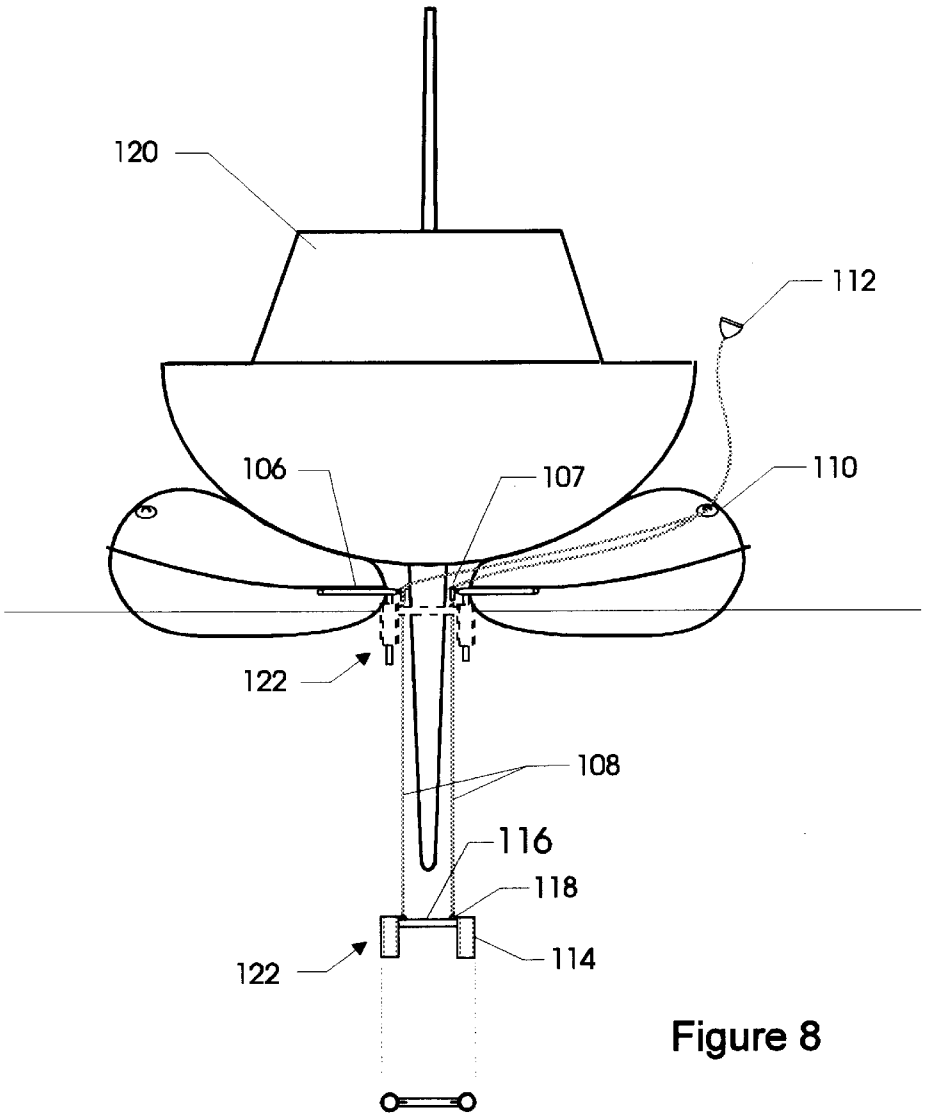
FIG. 8—is an elevation from the back of the inflatable floating boat lift for a sailboat.

FIG. 8 (elevation) shows another embodiment of the invention for use with a sail boat with a movable structural support shown in two positions, and also shown in a rotated (top) view.

This embodiment is similar to the embodiment for a large boat or ship shown in FIG. 6 except that an airbag assembly for sailboat 100 has main air chambers 6A an 6B and front air chambers 93 and 94 separate from each other and connected to a rigid structural frame device 106 with a plurality of ropes 36 through a plurality of grommets 32. This configuration leaves an opening for a keel of a sailboat 120. At least one sliding support assembly 122 is moved into place on a plurality of pegs 109, which are attached to frame 106, after sailboat 120 has been positioned on an airbag assembly for sailboat 100. Sliding support assemblies 122 are made of a heavy rigid material and include a plurality of cylinders 114 connected by a bar 116 with a plurality of loops 118 attached for connecting to a plurality of ropes 108. Support assemblies 122 are raised and lowered by ropes 108 which are connected to a plurality of handles 112 and threaded through a plurality of rope guides 107 and a plurality of loops 110.

OPERATION FIGS. 7, 8

The operation is the same as described in operation of FIG. 1A, 1B, 1C, 2, 3 with the following addition. Sliding support assemblies 122 are raised into place on pegs 109 of rigid frame 106 by pulling handles 112 after boat 120 has been maneuvered onto airbag assembly for sailboat 100 and before air chambers 6A, 6B, 93, and 94 are inflated. When in the raised position, support assemblies 122 add substantial support to frame 106. Once chambers 6A, 6B, 93, and 94 have been inflated, the pressure of the fabric against the hull of boat 120 secures ropes 108 and subsequently sliding supports 122. When these same chambers are deflated, sliding supports 122 lower themselves by gravity and allow the keel of boat 120 to pass through.

CONCLUSION, RAMIFICATIONS, AND SCOPE OF INVENTION

Thus the reader will see that the inflatable floating boat lift has many advantages over other systems currently in use. The benefits of this invention are summarized below:

1. It provides a more affordable boat lifting device.
2. It provides a boat lifting device that works in any depth of water adequate to float the boat.
3. It provides a boat lifting device that automatically adjusts for changing water levels.
4. It provides a boat lifting device that is easier to transport.
5. It provides a boat lifting device that is easier to install and remove.
6. It provides a boat lifting device that is easier to store out of sight.
7. It provides a boat lifting device that will not damage the boat hull or propeller.
8. it provides a boat lifting device that will facilitate draining of the boat hull
9. it provides a boat lifting device that does not require 110 volt electrical current or manual labor for operation.

While the above description contains many specificities, these should not be construed as limitations on the scope of the invention, but rather as an exemplification of one preferred embodiment thereof. Many other variations are possible. For example, the invention may use other shapes, sizes, or materials of the components. The invention may also have only one main air chamber or a plurality of air chambers in a linear array. It may also have pairs of air chambers in a linear array, or a combination of chambers and pairs of chambers. Also, the auxiliary air chambers may be a hollow structure, or constructed from a buoyant material such as foam. Also, the auxiliary chambers may be attachable externally to the main air chamber or chambers.

Accordingly, the scope of the invention should be determined not by the embodiment illustrated, but by the appended claims and their legal equivalents.

I claim:

1. An inflatable floating airbag assembly for the purpose of raising a boat above the water comprising:

at least one air chamber that when inflated, raises and supports the boat above the water;

whereas said chamber provides stability;

at least one buoyant device attachable to the at least one air chamber which provides floatation for the inflatable floating airbag assembly when the at least one air chamber is deflated;

an air supply system connectable to the at least one air chamber for providing air thereto;

wherein supplying air to the at least one air chamber acts to inflate the at least one air chamber thereby raising the boat above the water and removing air from the at least one air chamber acts to lower the boat back into the water.

2. The inflatable floating airbag assembly of claim 1 wherein the at least one buoyant device is internal to the at least one air chamber.

3. The inflatable floating airbag assembly of claim 1 wherein the at least one buoyant device is external to the at least one air chamber.

4. The inflatable floating airbag assembly of claim 1 wherein the at least one buoyant device includes an auxiliary inflatable air chamber having a means mounted to the at least one buoyant device for supplying and removing air therefrom, and;

wherein the size of the at least one buoyant device can be altered by adding or removing air.

5. The inflatable floating airbag assembly of claim 1 wherein the at least one buoyant device is a non-inflatable device internal to the at least one air chamber.

6. The inflatable floating airbag assembly of claim 1 wherein the non-inflatable device is external to the at least one air chamber.

7. The inflatable floating airbag assembly of claim 1 wherein the at least one buoyant device is attachable to at least a portion of the perimeter.

8. The inflatable floating airbag assembly of claim 1 wherein the at least one buoyant device provides a means for guiding the boat onto the inflatable floating airbag assembly.

9. The inflatable floating airbag assembly of claim 1 wherein the at least one buoyant device provides a means for stopping the boat is forward motion when maneuvering the boat onto the inflatable floating airbag assembly.

10. The inflatable floating airbag assembly of claim 1 wherein the at least one buoyant device provides a means for adjusting the size of a space for receiving a hull of the boat.

11. The inflatable floating airbag assembly of claim 1 including:

a plurality of air chambers connectable together in a linear array.

12. The inflatable floating airbag assembly of claim 1 including:

at least one pair of air chambers;

wherein the air chambers of each pair are connectable together side by side.

13. The inflatable floating airbag assembly of claim 12 including:

a plurality of pairs of chambers connectable together in a linear array.

14. The inflatable floating airbag assembly of claim 1 including:

at least one pair of air chambers;

wherein air chambers in a pair are connectable together side by side and;

at least one single air chamber;

wherein said at least one pair of chambers and said at least one single air chamber are connectable together in a linear array.

15. The inflatable floating airbag assembly of claim 1 including:

a plurality of air chambers connectable together in a linear array providing a means for adjusting the attitude of the boat.

16. The inflatable floating airbag assembly of claim 1 including:

a pair of air chambers connectable together side by side providing a means for adjusting the list of the boat.

17. The inflatable floating airbag assembly of claim 1 including:

at least three air chambers connectable together to provide a means for adjusting the attitude of the boat and a means for adjusting the list of the boat.

18. The inflatable floating airbag assembly of claim 1 including:

a means connectable to the at least one air chamber for removing air therefrom.

19. The inflatable floating airbag assembly of claim 1 for raising a boat having a fin on the bottom of its hull comprising:

a rigid trough device attachable on a top side of the inflatable floating airbag assembly for protecting the inflatable floating airbag assembly from the fin on the bottom the hull.

20. An inflatable floating boat lift for the purpose of raising a boat above the water comprising:

at least one air chamber that when inflated, raises and supports the boat above the water;

whereas said chamber provides stability;

at least one buoyant device attachable to the at least one air chamber which provides floatation for the inflatable floating airbag assembly when the at least one air chamber is deflated;

an air supply system connectable to the at least one air chamber for providing air thereto;

wherein supplying air to the at least one air chamber acts to inflate the at least one air chamber thereby raising the boat above the water and removing air from the at least one air chamber acts to lower the boat back into the water;

a level sensing means mountable inside the boat for detecting undesirable list of the boat;

a means connectable to the at least one air chamber for rapid deflation thereof;

means for coupling the level sensing means to the means to rapidly deflate the at least one air chamber so that upon undesirable list of the boat, the air chamber is rapidly deflated whereby the boat returns to it's original floating position in the water.

21. The inflatable floating boat lift of claim 20 comprising:

a valve connectable to at least one inflatable pipe plug insertable into a rigid cylinder attachable to each at least one air chamber;

thereby opening the valve releasing air from the at least one pipe plug, allowing the at least one pipe plug to constrict in size, so that the pressure in the at least one air chamber expels the at least one pipe plug from the at least one cylinder, whereby air rapidly escapes from the at least one air chamber, thereby lowering the boat to its original floating position in the water.

22. An inflatable floating airbag assembly for the purpose of raising a sailboat above the water comprising:

at least one air chamber that when inflated, raises and supports the boat above the water;

whereas said chamber provides stability;

at least one buoyant device attachable to the at least one air chamber which provides floatation for the inflatable floating airbag assembly when the at least one air chamber is deflated;

an air supply system connectable to the at least one air chamber for providing air thereto;

wherein supplying air to the at least one air chamber acts to inflate the at least one air chamber thereby raising the boat above the water and removing air from the at least one air chamber acts to lower the boat back into the water;

a rigid frame device separating portions of the at least one air chamber and attachable to at least a portion of the at least one air chamber, thereby providing a space for a keel of the sailboat.

23. The inflatable floating airbag assembly of claim 22 including:

at least one detachable structural support movable to a position coupled to said rigid frame for providing additional support to said frame.

24. The inflatable floating airbag assembly of claim 23 wherein the rigid frame includes:

at least one pair of rigid pegs connectable to and protruding down from the rigid frame to receive said at least one detachable structural support.

25. The inflatable floating airbag assembly of claim 24 wherein the rigid frame includes:

at least one pair of rigid guides for ropes connectable to said rigid frame;

at least one pair of ropes for connection to said at least one detachable structural support, and threadable through said at least one pair of rigid guides;

whereby pulling on the ropes causes the at least one structural support to rise and engage with the at least one pair of pegs, whereby adding structural support to the said rigid frame.

* * * * *